United States Patent [19]

Moser

[11] 4,187,413

[45] Feb. 5, 1980

[54] HEARING AID WITH DIGITAL PROCESSING FOR: CORRELATION OF SIGNALS FROM PLURAL MICROPHONES, DYNAMIC RANGE CONTROL, OR FILTERING USING AN ERASABLE MEMORY

[75] Inventor: Ludwig M. Moser, Estenfeld, Fed. Rep. of Germany

[73] Assignee: Siemens Aktiengesellschaft, Berlin & Munich, Fed. Rep. of Germany

[21] Appl. No.: 894,348

[22] Filed: Apr. 7, 1978

[30] Foreign Application Priority Data

Apr. 13, 1977 [DE] Fed. Rep. of Germany ..... 2716336

[51] Int. Cl.[2] ..... H04R 25/00

[52] U.S. Cl. ..... 179/107 FD; 179/107 R

[58] Field of Search ..... 179/107 R, 107 FD

[56] References Cited

U.S. PATENT DOCUMENTS 3,531,595 9/1970 Demaree ..... 179/1 N 3,989,904 11/1976 Rohrer et al. ..... 179/107FD 4,051,331 9/1977 Strong et al. ..... 179/107 R

*Primary Examiner*—George G. Stellar

*Attorney, Agent, or Firm*—Hill, Van Santen, Steadman, Chiara & Simpson

[57] ABSTRACT

In an illustrated embodiment a behind-the-ear hearing aid includes a microphone, an amplifier-low pass filter circuit, an analog to digital converter, a digital integrated circuit arithmetic and logic unit for implementing a n-th order transfer function in the Z domain, a digital to analog converter and an output transducer, for producing the desired sound response. A memory multiplexer is provided for loading of the multiplier coefficients necessary to adapt the transfer function circuit to essentially any class of hearing deficiency into an erasable programmable read only memory (EPROM). The structure is such that the coefficient memory may be loaded after the standard universal hearing aid has been completely assembled, and indeed the hearing aid may be reprogrammed as needed after a period of use, essentially without disassembly.

10 Claims, 7 Drawing Figures

HEARING AID WITH DIGITAL PROCESSING FOR: CORRELATION OF SIGNALS FROM PLURAL MICROPHONES, DYNAMIC RANGE CONTROL, OR FILTERING USING AN ERASABLE MEMORY

BACKGROUND OF THE INVENTION

The invention relates to a method for adapting the transmission function of a hearing aid to various types of hearing difficulty, and to hearing aids for the implementation of this method. A device of this general type is known from the German Patent No. 15 12 720.

With conventional hearing aids, there are problems in being able to adapt the characteristic data as well as possible to the individual hearing impairments of a person with difficulty in hearing. The electrical properties of hearing aid amplifiers are determined by the structural elements used in the construction and at most can only be varied to a slight extent by external controls. This means that there must be a plurality of hearing aids which differ from one another for instance only in the frequency response to the amplifier.

Hitherto, therefore, it has not been possible to find a uniform form of construction for hearing aids. At the present time alone there are several hundred models on the hearing aid market which can be sorted into classes only by consideration of individual parameters.

A further series of types must be adapted to the dynamic range of an afflicted hearing, this range being changed, for example restricted, with various types of hearing difficulty. These hearing aid amplifiers have additional control loops in order to be able to adjust the output level of the hearing aid to the limits suitable for the hearing for which provision is to be made.

According to one particular construction, such as is described for example in the German Offenlegungsschrift No. 23 16 939, an adaptation can also be effected by the frequency range transmitted by the hearing aid being split into at least two partial ranges, to each of which there is coordinated a separate level control acting independently of the other frequency ranges, with one or more control loops in each case. This construction also results in an extensive system of structural elements, so that there are difficulties in obtaining the small construction which is both customary and desirable in hearing aids.

SUMMARY OF THE INVENTION

The invention proceeds from the assumption that the transmission function of a hearing aid is essentially determined by the properties of the transducers, the amplifier electronics and the physical dimensions of the sound inlets. They are determinative: (a) for the frequency response; (b) for the input-output dynamics; and (c) for the transient response.

Re (a):

The frequency response of a hearing aid is prescribed by the choice of the structural elements in a conventional hearing aid amplifier. If this frequency response is to be controlled by adjusting controls, the possibilities for so doing in the hearing aid are very restricted by the confined space conditions. The confined space virtually allows only a simple tone control or sound balance. The effectiveness of these adjusting controls is limited, since filter slopes greater than 12 dB/octave are not possible due to the known lack of space.

Re (b):

The input-output dynamics of a hearing aid should be able to be adapted as well as possible to the dynamic behavior of the hearing which is to be amplified. For this purpose the known PC (Peak-Clipping) limiting circuits and AGC (Automatic Gain Control) control circuits are used; the first are static adjusting controls, whilst the second possibility is a dynamic control. This brings us to the third point.

Re (c):

Each control is time-dependent; automatic adjustment of the amplification is not effected inertialessly.

The aforementioned points show that a "standard hearing aid amplifier" must therefore display all the aforesaid properties. With the present structural elements, the number of adjusting controls and control elements would be such that it would be impossible to manufacture a device to be worn on the head, for example behind the ear. Using amplifiers of known construction and corresponding design the space requirement cannot be met in these devices.

With a method for adapting the transmission function of a hearing aid to various types of hearing difficulties, it is an object of the invention to disclose a simple construction which can be accommodated in small devices and which is at the same time very effective as regards hearing defects to be compensated. According to the invention this object is solved by a process characterized in that the analogue sound signal to be transmitted is converted into a digital signal, is then subjected to a discrete signal processing based on selected stored parameters matched to the difficulty in hearing for which provision is to be made, that the digital signal is then converted back into an analogue electrical signal and is converted into sound in a manner known in the case of hearing aids.

An adaptation to the requirements of a hearing aid for the hard of hearing can be obtained in simple manner through the principle in accordance with the invention, i.e. the adjustment or control, i.e. alteration, of the transmission function of hearing aids effected by an arithmetic unit. This construction permits the parameters determining the frequency response and the dynamic behavior to be stored in suitable memory locations in the form of numerical values. In contrast to known electronic amplifier hearing aids, the new devices can be regarded as digital or computer hearing aids. With these, there is also achieved the advantage that parameters determining the transmission function of a hearing aid which have been read into a memory can also be modified again, i.e. one is not bound to a specific amplifier structure. The invention introduces a standard hearing aid wherein all the necessary transmission functions can be adjusted on the finished device after assembly has been completed.

A memory to be used may in this instance be designed such that it is charged only when the hearing aid is adapted to the afflicted hearing. This may be a single occurrence or, when using suitable erasable memories, can be altered as required. In American usage such memories are called "erasable programmable read only memory" and, in abbreviated form, "EPROM". An extensive variability of adaptation of hearing aids is particularly important for subsequent corrections of characteristic curves.

A memory which can be used in accordance with the invention should, for example, have the form of known microprocessors, of which one is described e.g. in the pamphlet "DAC-76" of the firm Precision Monolithics Inc., 1500 Space Park Drive, Santa Clara, California 95050. With this construction, a memory can also be built into a hearing aid worn on the body and operated there. The transmission behavior of a hearing aid, which results from the properties of the transducers, i.e. microphone and earphone, and that of the amplifier; i.e. the transmission function of the device (characteristic curve), the amplitude of response to each input frequency component, which appears again e.g. as a received frequency at the hearing aid output, and/or the ratio of the input level to the output level, is controlled according to the invention by means of an arithmetic unit such that the input signals are altered for the purposes of compensation of a hearing defect; for example, adaptation to a sensitivity of hearing which is changed relative to occurring frequencies, for example, a narrower pass band, and adaptation to changed dynamics. The arithmetic unit should therefore additionally have a memory. An upper limit to the number of memory locations is given by the required upper cutoff frequency of the transmitted low frequency band. According to the invention, it is possible to alter all incoming sound signals in the desired manner such that the changed transmission function desired is achieved.

Signals which can be processed are obtained in the manner customary with hearing aids, in that the signal coming from the microphone is supplied to an amplifier and a low pass filter. The signal thus preliminarily treated is then supplied to an analogue-digital converter and converted into signals which can be processed with a computer transmission function H(z) in an arithmetic unit. This unit can contain, stored, the parameters which are to determine the transmission behavior of the system. A signal is then obtained from the arithmetic unit which, supplied to a digital-analogue converter for suitable conversion to analogue form, and, if necessary, after passing through a terminal amplifier, and supplied to an output transducer, for example an inserted earphone, is suitable for supplying sound which is adapted to the afflicted hearing.

Adjustment of the transmission function of the arithmetic unit can take place, for example, by way of a memory multiplexer. This is, as known, a structural element with which it is possible to selectively or sequentially load several memory locations by way of only one line. The incoming signals themselves can be used for effecting sequential address control. Establishing the parameters can be effected in the conventional manner by way of an audiometer. In an ideal development, the measured values determined in an audiometer can be transmitted directly via a memory multiplexer into the memory of the arithmetic unit for storage in the memory.

Further details and advantages of the invention will be explained hereinafter with reference to the exemplified embodiments illustrated in the accompanying sheets of drawings; and still further objects, features and advantages will be apparent from this detailed disclosure and from the appended claims.

DETAILED DESCRIPTION

Figure 1:
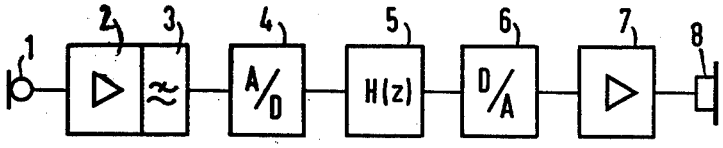
In FIG. 1 is shown a block circuit diagram of a hearing aid constructed in accordance with the invention.

FIG. 1 shows a block circuit diagram of a hearing aid with discrete signal processing. It comprises as input sound converter a microphone 1 of known construction which is supplemented by an amplifier 2. Using known TTL elements, energy sources with five volt (5 V) supply voltage can be used and with CMOS elements the voltage can be dropped to 1.5 V. The energy requirement therefore varies within a scope which can be satisfied even in the case of hearing aids.

The amplifiers 2 to be used in accordance with the invention operate at the same time as low pass filters 3 in order to present a limited signal to the following analogue-digital converter 4. The upper cutoff frequency of this signal should be less than half the sampling frequency. The known Sampling Theorem states that the sampling frequency should be fixed at least twice as great as the highest occurring signal frequency. If this is disregarded, the effect known as aliasing occurs, i.e. higher frequency components are reflected about the angular frequency. Depending on the type of analog-digital converter used, a holding circuit, not separately illustrated, is required before the conversion, the latter circuit holding the signal stable for the time required for the conversion.

A further block 5 identified with H(z) is connected to the analog-digital converter 4. In this block 5, the signal which occurs as input signal U(z), is controlled such that the output signal Y(z) is the product of $U(z) \times H(z)$.

In this instance, U(z) can be directly the numerical sequence generated at the output of the analog-digital converter 4. It may, however, particularly if a volume control is intended, be a modified numerical sequence which results in a correspondingly modified limited input-output characteristic curve. One possible method of obtaining the input-output characteristic curve would be to multiply the input value with the characteristic curve value; another method, particularly rapid in digital technology, would be to pick up the number produced by the analog-digital converter 4 as an address for a memory. The output value then lies in the memory location indicated by the address. This method is particularly fast and, with eight bit words, only requires 256 memory locations. Such a memory may be taken as included within the component 4 or 6 of FIG. 1.

For realization of the function, the block 5 contains memories, multipliers and adders. If care is taken that the computing time of the multipliers is fast enough, all the multiplications can run over one multiplier with the use of time division multiplexing. There need not then be a multiplier for each multiplication.

If an upper signal band width of 6 kHz is judged satisfactory, a sampling frequency of at least 12 kHz results. With a factor of 2.3 there results a sampling frequency of 13.8 kHz or a time of 72.5 μsec between two values of the numerical sequence U(z). For the multiplication and addition of two eight-bit numbers, times of 115 nanoseconds are possible. This means that a single multiplier and adder can effect 630 operations in the time between two sampling values. This means that, with this construction, the transmission function can have up to 630 poles and zero positions.

To the output Y(z) of the transmission function H(z), i.e. the block 5, there is connected a digital-analog converter 6 which converts the discrete signal into a continuous signal. This signal is supplied to a receiver 8 via a terminal amplifier 7.

The parameters determining the transmission behavior of the device do not have to be fixed at the time of manufacture of the device. They can be determined at the actual time of adapting the device to an ear with impaired hearing, i.e. at the moment at which the charging of the memories (e.g. the loading of parameter values into EPROM 13–19, FIG. 2) also actually needs to be carried out. A memory multiplexer connected via a line 11 (FIG. 2) which is drawn in the block circuit diagram and designated by 12 (FIG. 2) can generally serve this purpose. This memory multiplexer 12 allows the parameter values to be read into the block 5 serially. These parameter values can be optimally fixed on the basis of audio-metrically determined characteristic data of the hearing for which provision is to be made.

Figure 2:
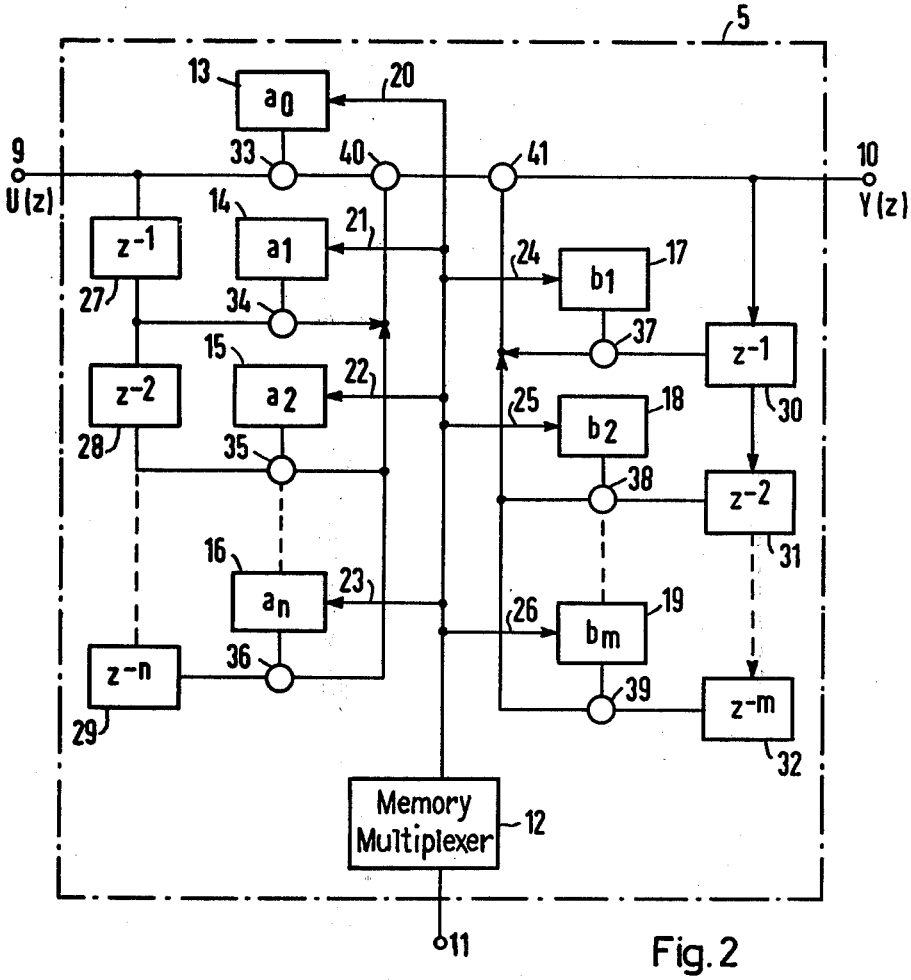
In FIG. 2 is shown a circuit for implementing the digital transmission function H(z) of FIG. 1.

In FIG. 2, to clarify its function, the block 5 of the memory computer unit is enlarged and emphasized with details. In this instance, the two connections to the converters 4 and 6 of FIG. 1 are indicated by the connecting points 9 and 10. The block 5 has a further connection 11 through which the parameters of the desired transmission function are introduced. A particularly accurate adaptation can be effected in that the audiogram is put into a form which is readable for the block 5 and this is then read into the block 5 by way of a multiplexer 12 in a manner known in computers. The multiplexer 12 controls the memory points in desired sequence, i.e. in the present case, the memory point 13, etc. to 16 first. Subsequent to this, reading into the points 17, etc. to 19 likewise follows. This reading-in of the parameters $a_o$ to $a_n$ and $b_l$ to $b_m$ is indicated by the arrows 20 to 26. The letters n and m in these expressions may each stand for the number four, respectively, corresponding to four parameters, according to which, in the present case, an adequate processing of the input signal can be effected. Further, the block 5 also contains discrete signal processing components 27 to 32. Function points in which the signals coming from 9 or 27 to 32 are processed corresponding to the parameters from storage locations 13 to 19 are indicated by circles 33 to 41. An output signal Y(z) can then appear at 10 by way of the coupling points illustrated as circles 40 and 41; the output signal, as indicated above, is altered by calculation in a known manner corresponding to the stored parameters such as $a_o$ to $a_n$ and $b_l$ to $b_m$. This signal can then be treated in the manner customary with hearing aids, specified in FIG. 1, and can be supplied to the ear.

The memory, i.e. the points or storage locations such as 13 to 19, can be constructed such that it can be erased by ultraviolet (UV) light or by electrical means. The invention thus offers a universally applicable unit for the manufacture of hearing aids.

As a result of the new method of signal conversion in the hearing aid, i.e. as a result of the discrete signal processing, it becomes possible to design the transmission function H(z) such that several input signals, for example those of two pick-up microphones, can be processed. In this way, the (two) inputs can be correlated with one another and an output signal obtained which has a substantially higher signal to noise ratio than is possible with only a single signal path.

Figure 7:
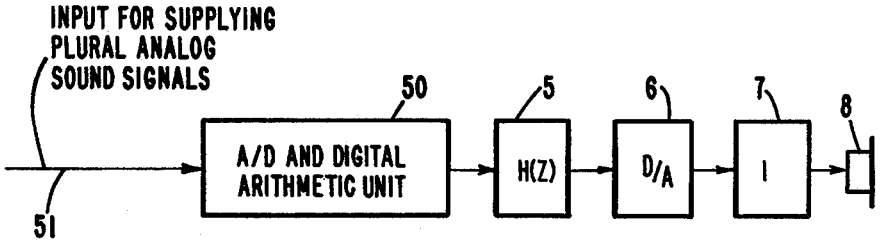
FIG. 7 on sheet 3 of the drawings is a diagrammatic view illustrating a modification of the invention wherein several input signals are individually converted to digital signals and are correlated in a digital arithmetic unit to provide a resultant output.

The input of plural analog sound signals for individual conversion to digital signals and for correlation in a digital arithmetic unit to provide a resultant digital output is indicated in FIG. 7 by means of component 50. Thus the plural inputs to the component 50 are correlated with one another and an output signal obtained which has a substantially higher signal to noise ratio than is possible with only a single signal path.

By way of example, component 5 of FIGS. 1 and 2 may be implemented as an integrated circuit microprocessor. Where the hearing aid receives several input signals e.g. from a microphone (such as shown at 62, FIG. 3), pick-up induction coils (such as shown at **62*a* in FIG. 3), etc., the input signals are individually converted to digital signals (as indicated by the legend applied to input means 51 in FIG. 7), whereupon the discrete signal values corresponding to essentially the same instant of time are correlated in the microprocessor to improve the fidelity of the resultant digital input signal based thereon, which resultant digital signal is then subjected to the processing step of component 5, FIGS. 1 and 2. By this means (as represented in FIG. 7), an improved signal to noise ratio may be achieved. Thus the component 50 in FIG. 7 may be described as analog to digital conversion and discrete signal correlation means. The component 5 may be designated time domain discrete signal processing means as indicated by the label applied to this component in FIG. 7**.

The memory used for components such as 13–19, FIG. 2, may be an operational part of the microprocessor and may be an erasable, electronically programmable read only memory, which can be electronically loaded with the selected parameters after it has been fully packaged as a behind-the-ear hearing aid, via a conventional memory multiplexer as indicated at 12 in FIG. 2. Preferably, the hearing aid may be reprogrammed after a period of use, as necessary, without any substantial disassembly of the hearing aid. Thus, for example, terminals such as 11, FIG. 2, and any other portion of the memory necessary to the erasure and reprogramming operations may be readily accessible from the exterior of the hearing aid.

An audiometer is shown in German Patent No. 10 16 894, and an improved audiometer operable by means of coded signals from a microprocessor is shown in my U.S. application for patent Ser. No. 888,843 filed Mar. 22, 1978, and corresponding to German Application No. P 27 19 796.2 filed May 3, 1977.

Figure 3:
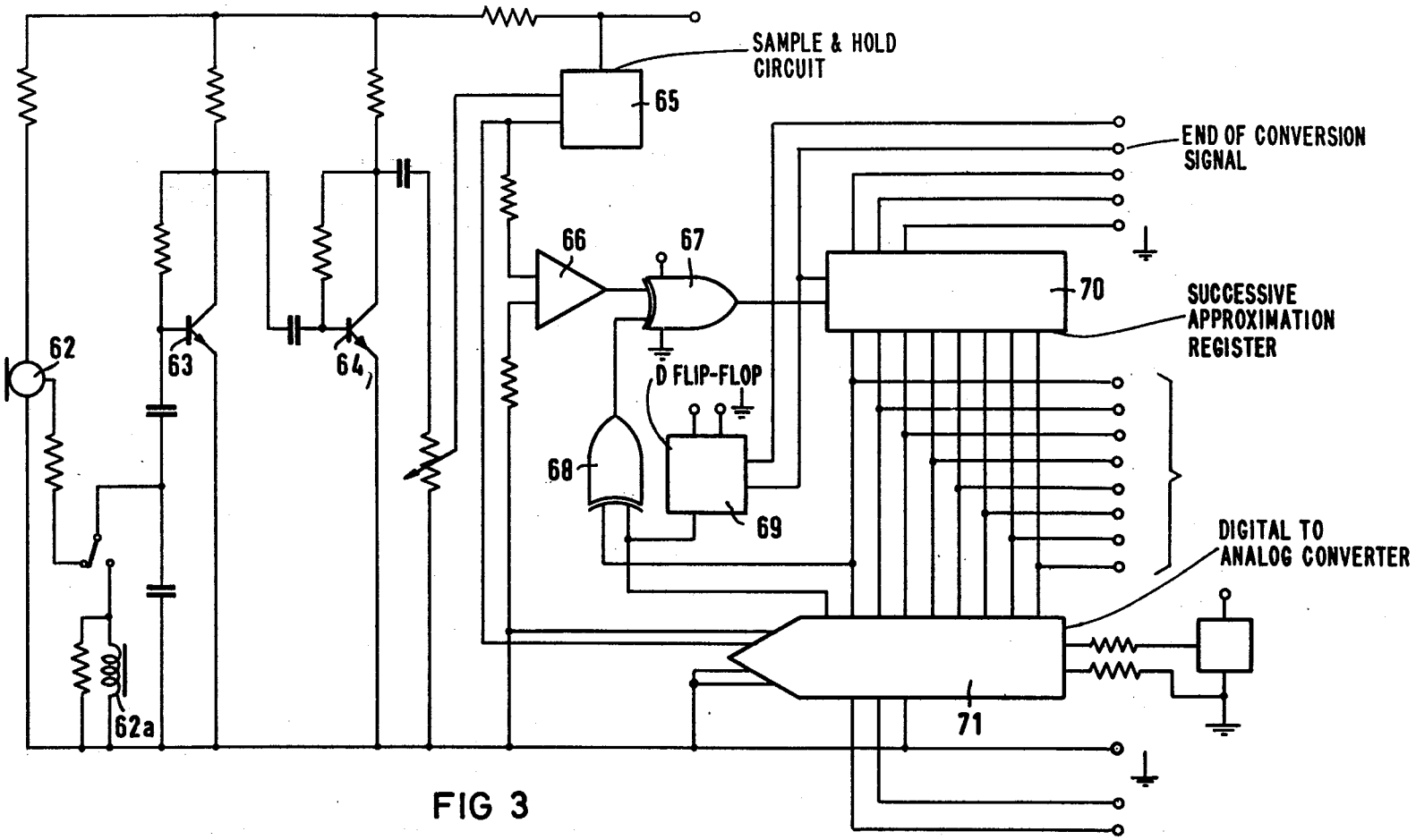
In FIG. 3 is shown the input stage of the hearing aid and an A/D converter.
Figure 4:
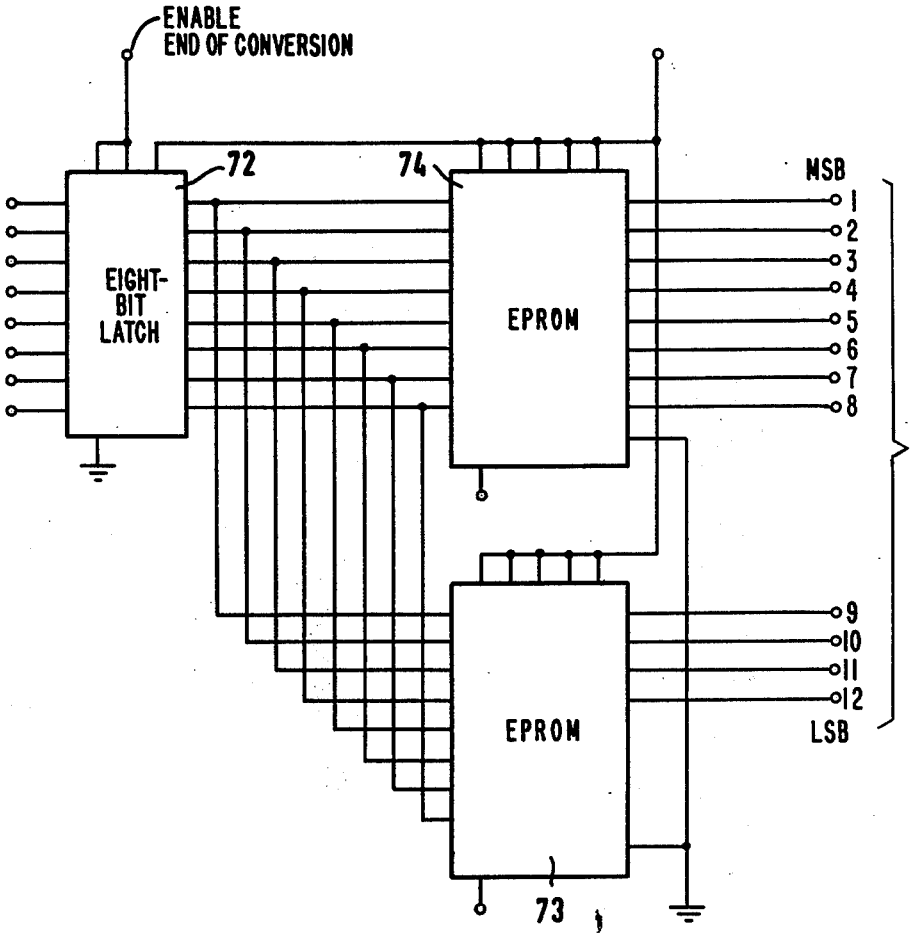
In FIG. 4 is shown an electrically programmed read only memory (EPROM) circuit for dynamic range compression, which circuit is associated with the output of the converter of FIG. 3.
Figure 5:
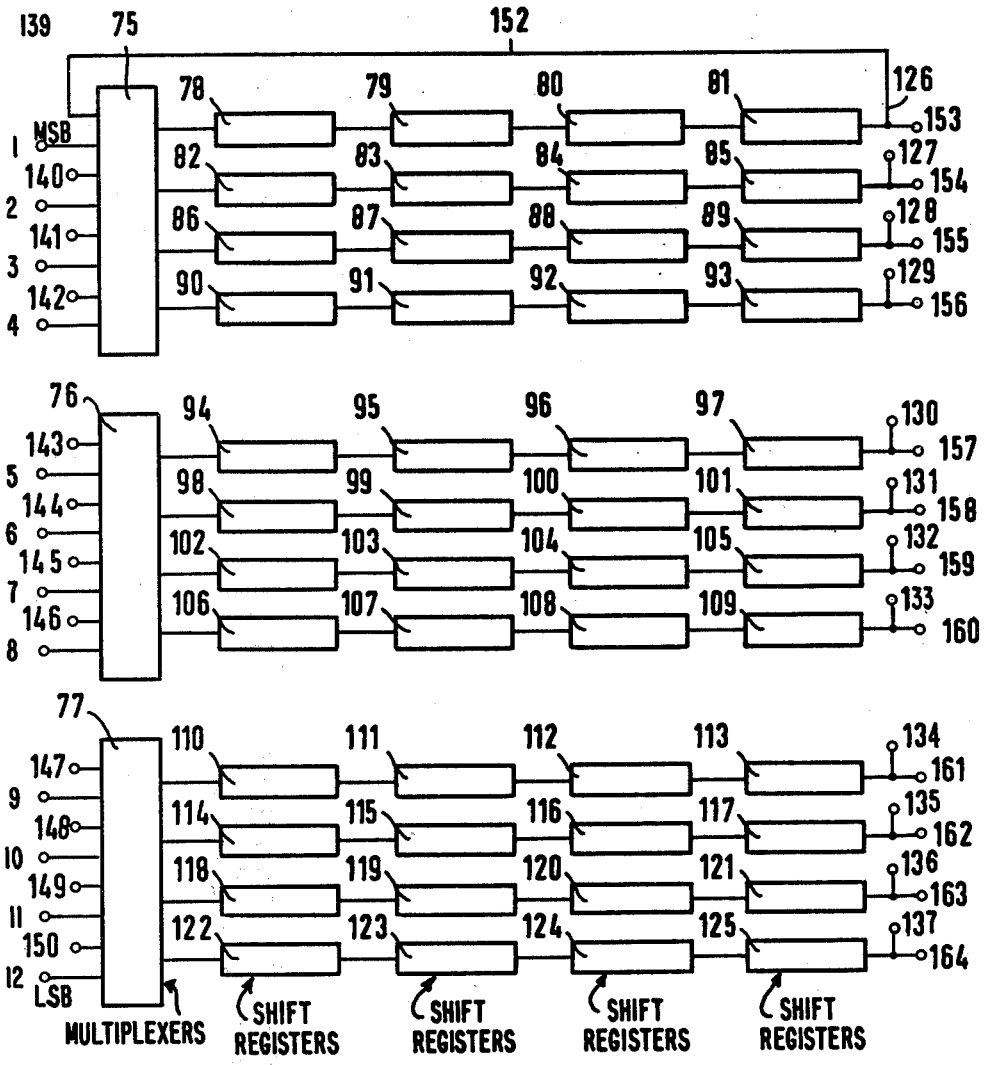
In FIG. 5 is shown circuitry for effecting a filtering operation on the output from FIG. 4.
Figure 6:
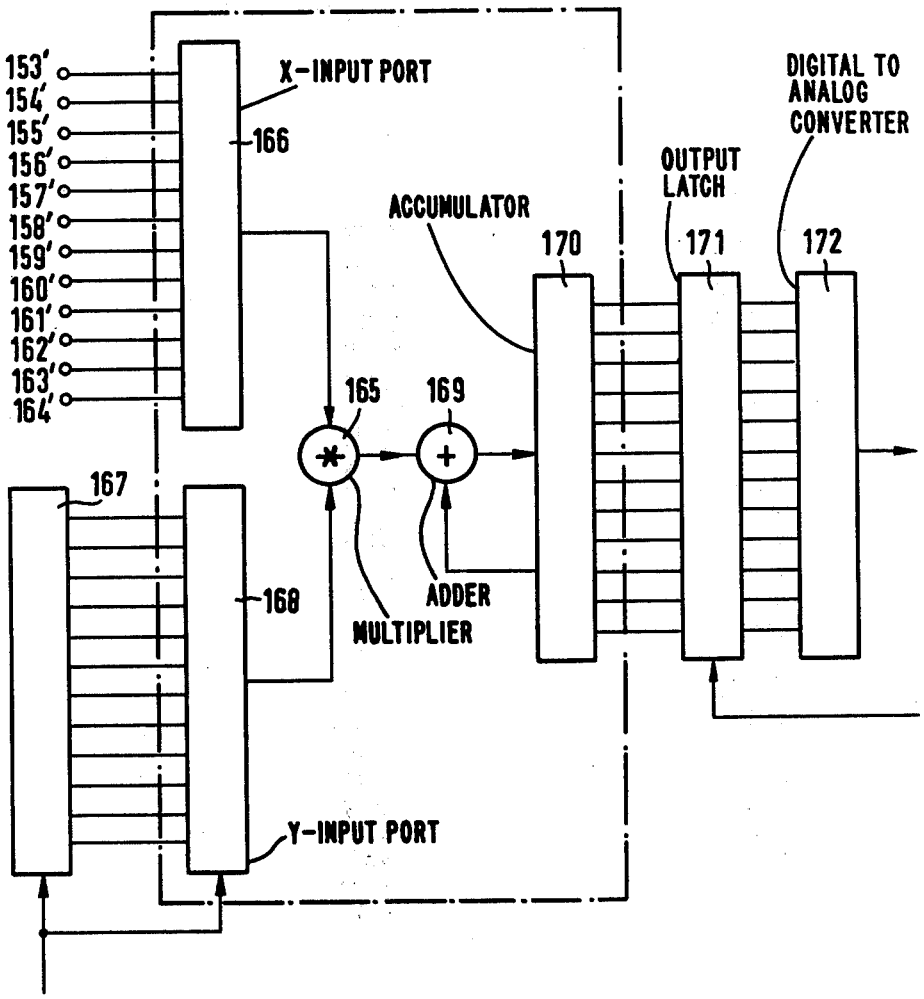
In FIG. 6 is shown a time multiplexed multipler and accumulator circuit with associated D/A converter, the input of FIG. 6 being connected to the output of FIG. 5.

Circuit Description of a hearing aid following the greater detailed illustration of FIGS. 3 to 6 whereby:

in FIG. 3 is shown the input stage of this hearing aid and A/D-converter, in FIG. 4 is shown EPROM dynamic range compression, in FIG. 5 is shown timemultiplexing of input values (for a FIR-filter length, 53 i.e.h ($\nu$) for $\nu=0(1),32$) and in FIG. 6 is shown a time multiplexed multiplier and accumulator, D/A-converter.

In the input stage of the hearing aid an input transducer like a microphone 62 or a telephone coil 62a gives a signal which is amplified and band limited in the two transistors 63, 64 amplifier stage. The continuous analog signal is sampled and held in a sample and hold amplifier 65 (Burr Brown SHC 80 KP or equivalent).

The sample impulse is taken from the END OF CONVERSION impulse of the A/D converter. The A/D (analog to digital) converter is built with a comparator 66 (CMP 01 from PMI) two exclusive OR-gates 67, 68 ($2\times\frac{1}{4}$ 7486) one D-flip flop 69 ($\frac{1}{2}$ of 7474) and one successive approximation register 70 (AM 2502), and one digital to analog converter 71 (COMDAC −76 from PMI). Each analog signal conversion results in an 8-bit digital word.

The 8-bit word of the A/D converter of FIG. 3 (output "8 data bits") is loaded into the input of 8-bit latch 72 (74100) of FIG. 4 with the END OF CONVERSION signal from the successive approximation register. The output lines of this latch are connected with the address lines of an erasable and programable read only memory 73 EPROM (2708).

The contents of this memory translate the 8-bit data word from the A/D converter into a 12-bit data word as used in further computations. The relationship between the input and output data word is such that all dynamic compression needed to fit a particular hearing damage, is stored as a table in the EPROM memory 74.

One implementation of the transfer function H(z) could be a finite impulse response-(FIR-) filter of FIG. 5. This FIR-filter can be implemented using only one multiplier in a time multiplexed configuration. This is called time multiplexing of the input signal in the literature. The 12-bit input signal is connected to the A-inputs of a 2:1 multiplexers 75 to 77 (74LS157). The output of that multiplexers 75 to 77 are connected to shift registers 78 to 125.

Shown are 4 times 8=32 stages in each of the 12 rows 78 to 81, 82 to 85 and so on of shift registers 78 to 125. This is sufficient for a FIR-filter of degree 32. All outputs 126 to 137 have connections with multiplexer 75 to 77 B inputs 139 to 150. In FIG. 5 only the connection of the first output 126 to B input 139 is shown and indicated as 152. The multiplexers 75 to 77 inputs B are active during 31 of the 32 shift pulses. At the 32th pulse inputs B are deactivated and inputs A coming from the output "Data for FIR-filter" of FIG. 4 and entering multiplexers 75 to 77 at the lines with the same numerals (nos. 1–12 respectively) as indicated at the output of FIG. 4, are activated. This shifts a new data word into the shift registers 78 to 125. At the same time the oldest data word, that is 32 sample pulses old, is lost. It is no longer needed in the computational process.

The outputs at 153 to 164 of the shift registers 78 to 125 and connected to 153′ to 164′ of the inputs of the hearing aid parts (input from time multiplexing SR) are the 12-bit input word for the multiplier X-input port 166 (FIG. 6). The output of an EPROM (2708) 167 is the 12-bit input word for the Y-input 168 of the multiplier 165. The contents of this EPROM memory 167 (Filter coefficients memory) control the transfer function H(z). At 169 all signals multiplied at 165 of one row 78 to 81 etc. are added. Every time the multiplexer gates A are activated, the contents of the multiplier accumulator 170 are latched into an output latch 171 and the accumulator is cleared. The output of that latch is the input for a digital to analog (D/A) converter (AD7521) 172. The output of that D/A converter is low pass filtered and amplified in the final stage of the hearing aid amplifier. This final stage drives the hearing aid output amplifier 7 and transducer 8 of FIG. 1.

It will be apparent that many modifications and variations may be effected without departing from the scope of the novel concepts and teachings of the present invention.

I claim as my invention:

1. A method for adapting the transmission function of a hearing aid to various types of hearing difficulty, characterized in that the analog sound signal to be transmitted is converted into a digital signal, is then subjected to a discrete signal processing based on selected stored parameters matched to the difficulty in hearing for which provision is to be made, that the digital signal is then converted back into an analog electrical signal and is converted into sound in a manner known in the case of hearing aids, characterized in that several input signals are individually converted to digital signals, and are correlated in a digital arithmetic unit to provide a resultant output.

2. A hearing aid system comprising receiving means for receiving an audio signal, output means comprising a transducer for producing an auditory signal, an analog to digital converter coupled to said receiving means and operative to supply a converted signal in digital form in accordance with the audio signal, discrete signal processing means connected with said analog to digital converter and comprising a finite impulse response (FIR) filter circuit for processing an input signal in accordance with said converted signal to provide a filtered signal with a frequency response adapted to the frequency response of the receiving and output means and of the ear, and erasable memory means for storing filter parameters for said finite impulse response (FIR) filter circuit, a digital to analog converter connected with said filter circuit to supply an analog signal in accordance with said filtered signal, and circuit means for amplifying the analog signal to provide an amplified analog signal and for supplying said amplified analog signal to said output means for producing an auditory signal in accordance therewith.

3. A hearing aid system comprising receiving means for receiving an audio input signal, an analog to digital converter coupled to said receiving means for supplying a converted signal in digital form in accordance with said audio input signal, memory means connected with said analog to digital converter and having an input-output characteristic to supply a translated signal in accordance with said converted signal but with each input digital value translated into an output digital word, the input-output characteristic of said memory means serving to adjust the dynamic range of the audio input signal without introducing time delay, said memory means comprising an erasable memory for storing input-output characteristic values for providing said input-output chacteristic, a digital to analog converter coupled with said memory means to supply an analog signal with adjusted dynamic range in accordance with the translated signal, circuit means to amplify and process the analog signal, and transducer means responsive to the amplified and processed analog signal for producing an audio output signal.

4. A hearing aid system comprising discrete signal processing means comprising analog to digital conversion means for receiving a plurality of analog audio input signals and for converting each analog audio input signal into a discrete signal, and comprising discrete signal correlation means and discrete signal filtering means for correlating the discrete signals in accordance with said plurality of audio input signals and for producing a resultant discrete signal which is correlated and filtered so as to be adapted to aid in hearing, digital to analog converter means for producing a converter analog output signal in accordance with said resultant discrete signal, amplifier means to amplify the converter analog output signal, and a transducer for producing an auditory output signal in accordance with the output of said amplifier means.

5. A hearing aid system according to claim 2, 3, or 4, with said discrete signal processing means comprising a microprocessor.

6. A hearing aid system in accordance with claim 4 with said discrete signal filtering means operating as a finite impulse response filter, and with said discrete signal processing means comprising translating means providing an input-output characteristic for translating each input discrete signal value into an output discrete signal value so as to adjust the dynamic range of the auditory output signal produced by said transducer, said translating means having an erasable memory for storing input-output characteristic values for providing said input-output characteristic.

7. A hearing aid system in accordance with claim 4 with said discrete signal correlation means comprising a digital arithmetic unit for correlating discrete signals in accordance with said plurality of analog audio input signals.

8. A hearing aid system in accordance with claim 4 with said discrete signal processing means providing erasable memory means for storing filter parameters, said discrete signal filtering means in conjunction with said erasable memory means operating as a finite impulse response filter.

9. A hearing aid system in accordance with claim 8 with said discrete signal processing means further comprising translating means providing an input-output characteristic for translating each input discrete signal value into an output discrete signal value so as to adjust the dynamic range of the auditory output signal produced by said transducer.

10. A hearing aid system in accordance with claim 9 with said translating means having an erasable memory for storing input-output characteristic values for providing said input-output characteristic.

* * * * *